US007021321B2

(12) United States Patent
Bigott

(10) Patent No.: US 7,021,321 B2
(45) Date of Patent: Apr. 4, 2006

(54) AUTOMATED KITCHENWARE WASHER

(75) Inventor: James W. Bigott, Fenton, MO (US)

(73) Assignee: X-Stream Technologies II, LLC, Fenton, MO (US)

( * ) Notice: Subject to any disclaimer, the term of this patent is extended or adjusted under 35 U.S.C. 154(b) by 0 days.

(21) Appl. No.: 10/674,913

(22) Filed: Sep. 30, 2003

(65) Prior Publication Data

US 2004/0118433 A1 Jun. 24, 2004

Related U.S. Application Data

(62) Division of application No. 09/784,750, filed on Feb. 15, 2001, now Pat. No. 6,659,114.

(51) Int. Cl.
*B08B 3/02* (2006.01)

(52) U.S. Cl. ..... 134/56 R; 134/105; 134/198; 134/184

(58) Field of Classification Search ..... 134/56 R, 134/58 R, 198, 108, 105, 186, 184
See application file for complete search history.

(56) References Cited

U.S. PATENT DOCUMENTS

| | | | | | |
|---|---|---|---|---|---|
| 1,508,828 | A | | 9/1924 | Wholey | |
| 2,217,531 | A | * | 10/1940 | Werneth | 134/199 |
| 2,289,890 | A | * | 7/1942 | Walter | 134/30 |
| 2,630,813 | A | * | 3/1953 | Murdoch | 134/175 |
| 2,649,765 | A | * | 8/1953 | Anderson | 134/104.1 |
| 3,129,711 | A | * | 4/1964 | Schmitt-Matzen | 134/56 D |
| 3,217,721 | A | | 11/1965 | Hertel | |
| 3,230,961 | A | | 1/1966 | Benkert et al. | |
| 3,279,481 | A | * | 10/1966 | Neyhouse et al. | 134/57 D |
| 3,586,011 | A | | 6/1971 | Mazza | |
| 3,621,856 | A | * | 11/1971 | Guth | 134/58 D |
| 3,846,615 | A | * | 11/1974 | Athey et al. | 392/441 |
| 4,004,600 | A | * | 1/1977 | Corn et al. | 134/57 D |
| 4,357,176 | A | | 11/1982 | Anthony | |
| 4,439,242 | A | * | 3/1984 | Hadden | 134/25.2 |
| 4,655,197 | A | * | 4/1987 | Atkinson | 601/161 |
| 4,673,441 | A | * | 6/1987 | Mayers | 134/18 |
| 5,197,499 | A | * | 3/1993 | Bodenmiller et al. | 134/95.2 |

(Continued)

FOREIGN PATENT DOCUMENTS

JP 11-128150 * 5/1999

*Primary Examiner*—Frankie L. Stinson
(74) *Attorney, Agent, or Firm*—Harness, Dickey & Pierce, P.L.C.

(57) ABSTRACT

An automated kitchenware washing tank has a pump system with a pump and fluid conduits to couple the pump between an intake opening through one of the walls and discharge openings in the wall of the tank. At least some of the discharge openings are preferably formed in at least one angled portion of the tank wall that faces downwardly into the tank, and, more preferably, on two opposed angled portions that face downwardly into the tank. A control system may be coupled to the pump for controlling the speed with which the pump supplies cleaning fluid to the discharge openings. The control system comprises a speed selector that is adapted to allow a user to activate the speed selector to select between at least two different speeds for pumping the cleaning fluid to the discharge openings. In operation, the automated washing tank pumps cleaning fluid from within the tank through the intake outlet through the fluid conduits and out of the discharge openings into the tank to create turbulence within the tank. The control system allows the turbulence level to be increased or decreased.

25 Claims, 9 Drawing Sheets

U.S. PATENT DOCUMENTS 5,241,975 A * 9/1993 Yanagihara ..... 134/56 D
5,333,631 A * 8/1994 Kirkland et al. ..... 134/104.1
5,470,142 A 11/1995 Sargeant et al.
5,525,161 A * 6/1996 Milocco et al. ..... 134/18
5,601,100 A * 2/1997 Kawakami et al. ..... 134/56 R
5,934,298 A 8/1999 Singh
5,961,937 A * 10/1999 Gobbato ..... 422/300
6,058,247 A * 5/2000 Lahey et al. ..... 392/399
6,260,565 B1 7/2001 Welch et al.
6,289,908 B1 9/2001 Kelsey
6,363,950 B1 * 4/2002 Nishibe et al. ..... 134/57 R
6,521,180 B1 * 2/2003 Sergio et al. ..... 422/28
6,550,488 B1 * 4/2003 McKee ..... 134/57 D
6,666,218 B1 * 12/2003 Lavoie et al. ..... 134/25.2
2004/0007256 A1 1/2004 Durazzani et al.

* cited by examiner

AUTOMATED KITCHENWARE WASHER

CROSS REFERENCE TO RELATED APPLICATION

This application is a divisional of U.S. patent application Ser. No. 09/784,750, filed Feb. 15, 2001, now U.S. Pat. No. 6,659,114, the entire disclosure of which is incorporated herein by reference.

FIELD OF THE INVENTION

The present invention relates to a commercial washer for washing large quantities of commercial kitchenware and, more specifically, to a washer having improved tank features and an automated control system for automatically dispensing cleaning agent into the tank and for automatically controlling fluid turbulence and temperature in the tank to increase the effectiveness of the washer and to allow the washer to clean dishware having varied fragility.

BACKGROUND OF THE INVENTION

Commercial washers have been in the marketplace for decades. Examples are shown in U.S. Pat. Nos.: 5,927,309; 5,775,347; 5,983,908; and 4,773,436, incorporated herein by reference. Many of the commercial washers that are currently on the market include multiple tanks for various cleaning stages (e.g., a scraping tank, washing tank, rinsing tank, and sanitizing tank). The washing tank, at a basic level, typically includes features such as a rectangular tank with a drain, a valve for closing the drain, outlet nozzles attached to walls of the tank for directing water down into the tank, and a pump to circulate water from within the tank into a manifold that feeds the water through the nozzles.

U.S. Pat. No. 4,773,436 discloses a tank of the variety discussed above. That patent discloses placing the nozzles on the rear wall and the pump intake valve on a sidewall. The nozzles are directed downwardly into the tank to direct water against the bottom wall of the tank near the front wall to create a circular water flow within the tank. As is common with commercial washers on the market, the pump is a single speed pump that creates a constant level of turbulence.

A problem not satisfactorily addressed by prior art and preexisting commercial washers is that, even within the commercial environment, not all dishware is sturdy or durable. For example, most restaurants use glassware, and fancier restaurants also include china or expensive ceramic plates. Prior commercial washers of the variety disclosed in U.S. Pat. No. 4,773,436 are not satisfactory for handling more delicate dishware. Rather, such prior art systems are best suited for handling larger pots and pans that are not subject to breaking under turbulent tank conditions. Moreover, some dishes contain inordinately "caked-on" food debris that requires higher turbulence than that provided for by existing commercial washers. The prior art does not provide a commercial washer with variable speeds to handle a variety of cleaning needs.

Further, the prior art commercial washers do not provide programmable cycles that enhance the cleaning process. Prior art commercial washers typically only provide an "on" or "off" mode. When in the "on" mode the washer runs at one speed (i.e., flow rate) and thus provides only one level of turbulence. It is, nonetheless, desirable to provide a tank that varies the cleaning parameters to tackle kitchenware that is more difficult to clean because food or grease has become caked-on the kitchenware during the cooking or food preparation process. The prior art systems do not, however, provide programmable controllers to provide cycles that vary the tank turbulence and/or temperature for predetermined time cycles.

Another problem associated with the prior art commercial washers is that pipes and nozzles unnecessarily extend from the side or back walls downwardly into the tank to supply water to the tank. Because most commercial washing tanks are typically full of dishware, the pipes and nozzles get in the way because they are under the surface of the water during normal operating conditions. Further, it is possible for personnel washing the dishes to catch their hands on the pipes and nozzles during the dishwashing process, thus causing injury. The pipes and nozzles also unnecessarily increase the cost of the dishwasher.

And yet another problem not solved by the prior art is the need for automatically introducing desired amounts of cleaning agent into the tank. In typical operation, a commercial washer will be used for several hours with a batch of water and a specified amount of cleaning agent (e.g., soap or intensified cleaners for tougher cleaning problems) in the water. If too much soap is added to the water, it leads to waste and "soap suspension," which diminishes the ability of the soap to attack grease. Adding too much soap also increases business overhead. Adding too little soap leads to the obvious problem that the dishware is not satisfactorily cleaned and sanitized. Further, commercial soaps and detergents are almost always contained in large, heavy containers. Employees manually lifting such heavy containers to pour cleaner into the water in the tank risk serious back and related injury, not to mention that it is difficult to control the amount of cleaning agent being dispensed into the tank in this manner. The prior art does not disclose an automated cleaner dispensing system that automatically dispenses a predetermined, desired amount of cleaner into the tank when necessary.

SUMMARY OF THE INVENTION

This invention is directed to a washing device and, more specifically, to an automated commercial washing tank for washing commercial kitchenware. The automated tank comprises a tank that is adapted to hold a fluid for washing kitchenware. The washing tank also includes outlets in the tank wall. A pump system includes a pump and fluid conduit system to couple the pump between an intake opening through one of the walls and the outlets. The pump draws cleaning fluid from within the tank through the intake opening into the fluid conduit system to the outlets into the tank. In the preferred embodiment, the outlets are discharge openings that are formed as openings in at least one of the walls, and do not include pipes or nozzles.

In a more specific aspect of the invention, the tank has a bottom wall and an enclosure wall. The enclosure wall is coupled to the bottom wall and extends upwardly from the bottom wall. The enclosure wall includes an angled portion directed generally downwardly into the tank. At least some of the discharge openings are located in the angled portion. In an even more preferred embodiment, the enclosure wall includes two angled portions and a group of discharge openings located, at least in part, in each angled portion. The angled portions are preferably opposed and directed downwardly into the tank to direct cleaning fluids from the openings generally downwardly into the tank in a crossing pattern.

In another aspect of the invention, a control system is coupled to the pump for controlling the flow rate with which the pump supplies the cleaning fluid to the outlets. The control system comprises a controller coupled to the pump system for causing the pump to alter the flow rate with which it pumps fluid, and a control that is adapted to allow a user to activate the controller to select between at least two different flow rates for pumping the cleaning fluid to the outlets. In the preferred embodiment, five different flow rates are available. In an even more preferred embodiment, the controller provides at least one preset program that, when activated by the control system, automatically adjusts the pump flow rate and/or temperature in the tank for at least two predetermined cycles to enhance the cleaning effectiveness of the tank.

In another aspect of the invention, the automated washer provides an overflow that comprises a cutaway portion in one of the walls. The cutaway portion preferably extends the full length of one of the sidewalls and is located at a height above the discharge openings. The overflow is preferably located adjacent a side tank that has a drain for fluid that spills over the overflow. Because grease and other debris float, the overflow also serves to dispose the grease and floating debris from the washing tank over the overflow.

In another aspect of the invention, an automated cleaner dispensing system is provided that automatically dispenses cleaner (e.g., soap or detergent) into the fluid in the tank. In the preferred embodiment, a fluid level sensor determines when the fluid level has dropped below a desired level and detects when the fluid level is thereafter increased above the desired level, indicative that the tank has been emptied and refilled. The control system, upon detecting the low level condition and the refill condition, causes a predetermined amount of cleaner to be dispensed into the tank.

Thus, the automated dishwasher disclosed herein overcomes problems associated with the prior art. The use of discharge openings for directing cleaning fluid in the tank eliminates the need for pipes and nozzles to do so. Thus, the nuisance of having the pipes and nozzles in the tank is eliminated and the overall cost of the dishwasher is decreased. Further, by providing outlets on more than one wall, and preferably opposed walls, tank turbulence is increased, thereby enhancing the washer's effectiveness in cleaning kitchenware. The control system aspect of the invention allows the pump pressure to be increased or decreased to account for varied conditions of kitchenware that must be cleaned. The preset program feature automates the cleaning process and also facilitates cleaning kitchenware having caked-on food by, for example, providing various cycles that can operate automatically overnight. The control system also allows for automated control of the cleaner dispenser and the heater. Thus, the dishwasher is adapted to clean all dishware, regardless of how fragile or dirty, and is much more effective and automated than prior art commercial kitchenware washers.

DETAILED DESCRIPTION OF THE PREFERRED EMBODIMENTS

The present invention is adapted to be included in a typical commercial washer system for commercial or large-scale kitchens. See FIG. 9. Commercial washer systems typically include several contiguous stations such as: an initial scraping station to remove bulk food items that have stuck to the dishware; a washing station to wash the remaining food items or food residues from the dishware; a rinsing tank to rinse the soap or cleaning fluids from the dishware; and a sanitizing station to sanitize the cleaned dishware. The washer of the present invention is capable of washing a variety of kitchenware, including dishware, food service ware and equipment, pots, pans, food trays, grease filters, gratings, or any other items found in commercial or large-scale kitchens that require cleaning.

Figure 1:
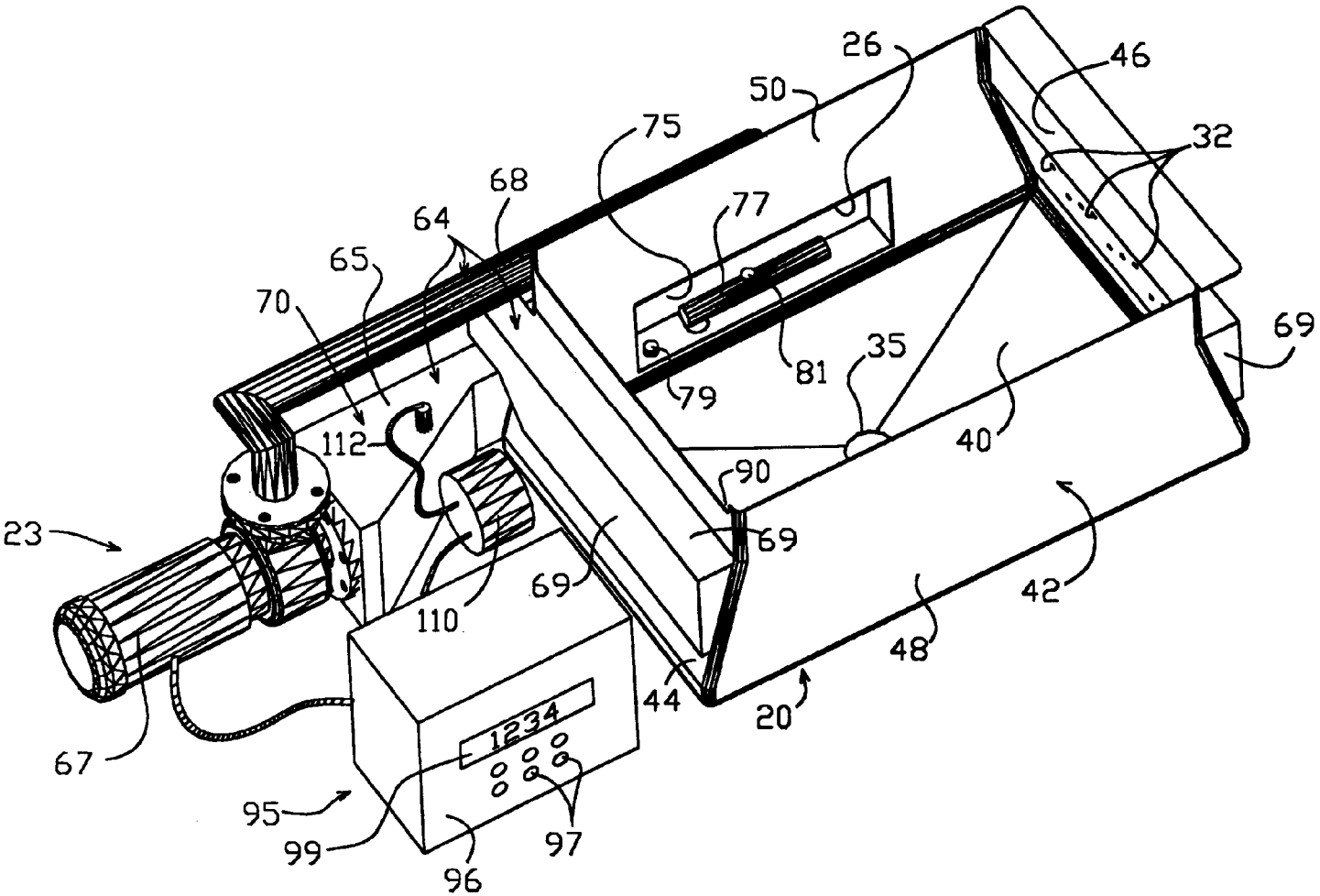
FIG. 1 is a perspective view of the preferred embodiment of the automated kitchenware washing tank of the present invention.
Figure 9:
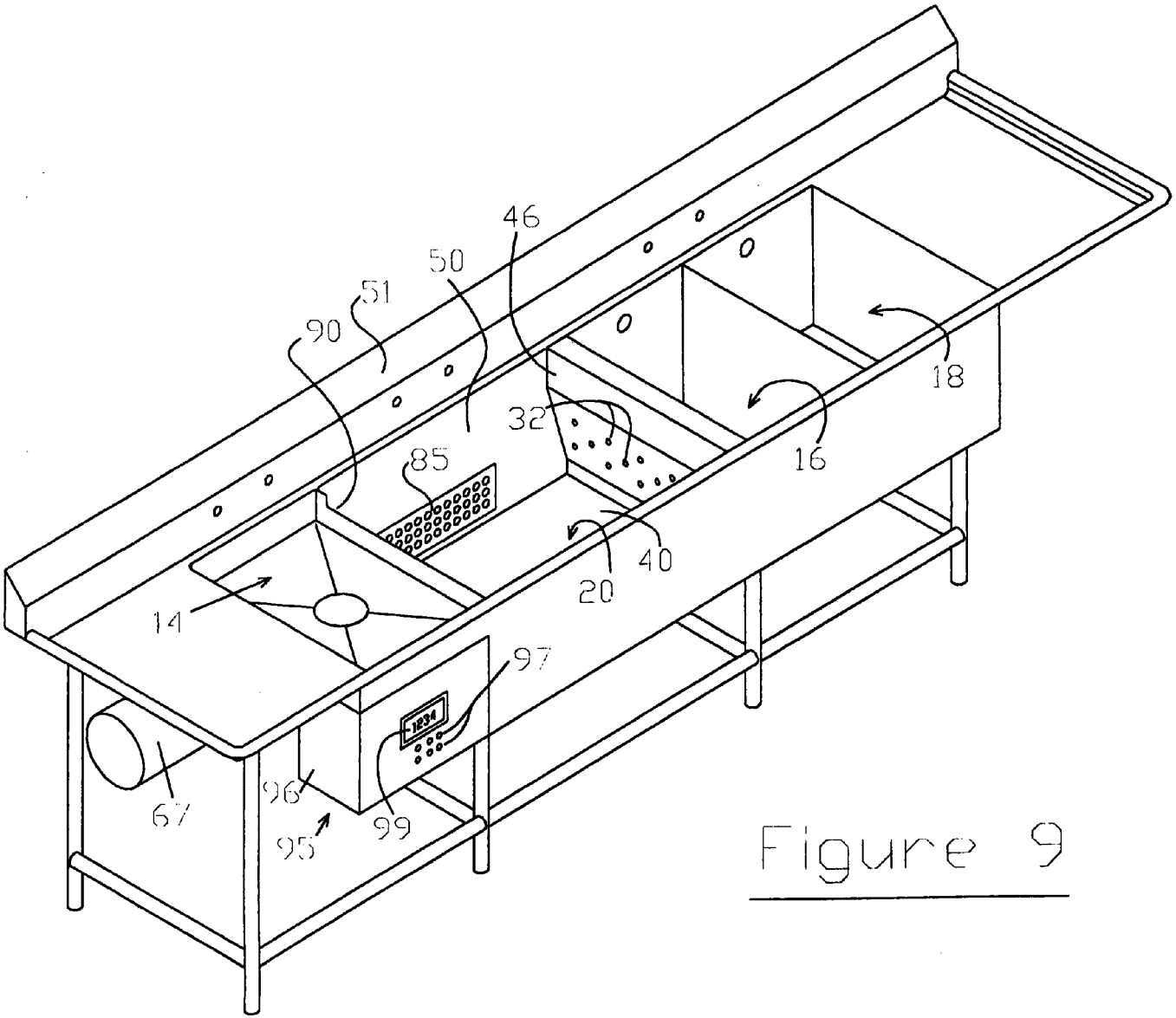
FIG. 9 is a perspective view of the automated washing tank of the present invention incorporated into a complete commercial kitchenware washing system.

Referring to FIG. 1, the automated washer of the present invention, at its most basic level, includes the following: a tank 20, a pump system 23, and outlets or discharge openings 32. The tank can and typically should include a drain and valve system 35 to allow the tank to be filled and emptied. The tank will also typically include a faucet (not shown) to fill the tank. Other features that are desirable are described below. In general operation, the tank is filled to a desired level. The pump system 23 pumps cleaning fluid (e.g., water and a detergent or soap) from tank 20 through intake opening 26 to outlets or discharge openings 32. The drain and valve system 35 should be in a closed position to maintain the cleaning fluid in the tank. FIG. 9 shows the tank of the present invention incorporated into an overall commercial washing system, including a scraping station 14, the automated kitchenware washing tank 20, a rinsing station 16, and a sanitizing station 18.

Tank 20 includes a bottom wall 40 and an enclosure wall 42. The enclosure wall is connected to the bottom wall along its outer edge. The enclosure wall 42 extends upwardly from the bottom wall 40. Preferably, four walls, 44, 46, 48, and 50, form the enclosure wall to maximize the tank volume. In use, the walls 44 and 46 are sidewalls, wall 48 is the front wall, and wall 50 is the back wall. Walls 44 and 46 are preferably shorter than walls 48 and 50 such that the tank 20 is wider than it is deep. The walls 44 and 46 are preferably about 28 inches in length and 18 inches in height. Walls 48 and 50 are preferably about 42 inches in length at the bottom edge and about 36 inches at its top edge, the difference accounting for the angled portions of walls 44 and 46. Wall 48 is preferably the same height as walls 44 and 46. Back wall 50 is preferably slightly higher by a few inches to provide a backsplash 51 (see FIG. 9). The dimensions are set forth as mere examples and can be varied as understood by those skilled in the art.

The shorter depth of the tank allows workers standing at the front wall to reach the back wall to obtain all dishes. The longer width of the tank increases the tank volume to allow it to hold more kitchenware. Workers are able to move laterally to reach all dishes along the longer front wall.

Again, the configuration could be different. For example, all walls could be the same size or the tank could be circular or some other geometric configuration. The walls are preferably stainless steel to provide a sturdy, long-lasting structure, but other materials could be used. For example, the tank could be molded in one piece from a durable plastic or other suitable material. The preferable thickness is fourteen-gauge stainless, type 304.

Bottom wall 40 is typically sloped to cause water to siphon to drain and valve system 35 when the drain is open. The drain and valve system is conventionally connected to the facility plumbing and drainage system (not shown). System 35 also includes a shutoff valve (not shown) that allows the user to open and close the drain to allow the tank to be filled and emptied as desired. The system 35 also preferably includes a screen or perforated cover (not shown) to prevent debris from siphoning down the drain and clogging or partially clogging it. The drain and valve system and its connection to facility plumbing is standard and in use in most commercial washers.

A commercial washer of the variety disclosed herein should be able to circulate fluid within the tank through a pump and back into the tank to create turbulence in the tank. The turbulence helps to clean kitchenware and loosen tough food residues or remnants that become caked-on kitchenware during the cooking or food preparation process. The following components generally provide this function in the present invention: the intake opening 26, the pump system 23, and outlets or discharge openings 32.

Figure 2:
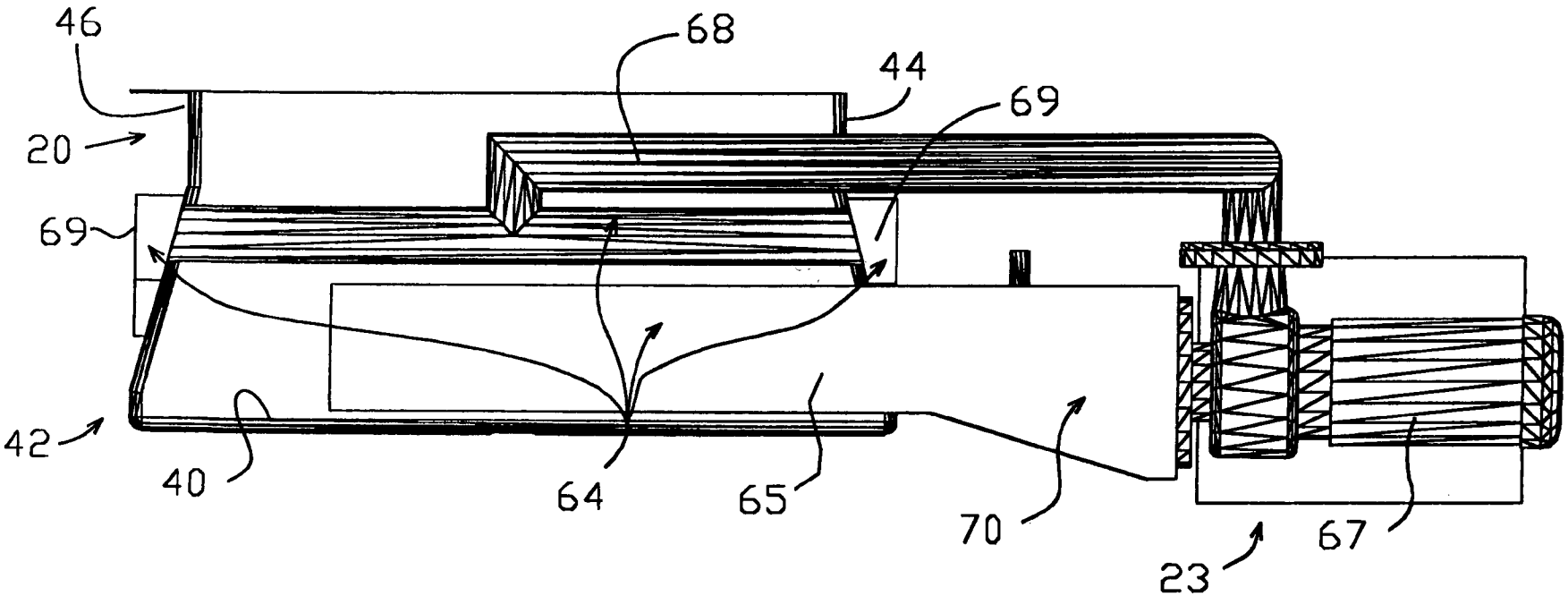
FIG. 2 is a rear elevation view of the tank thereof.
Figure 4:
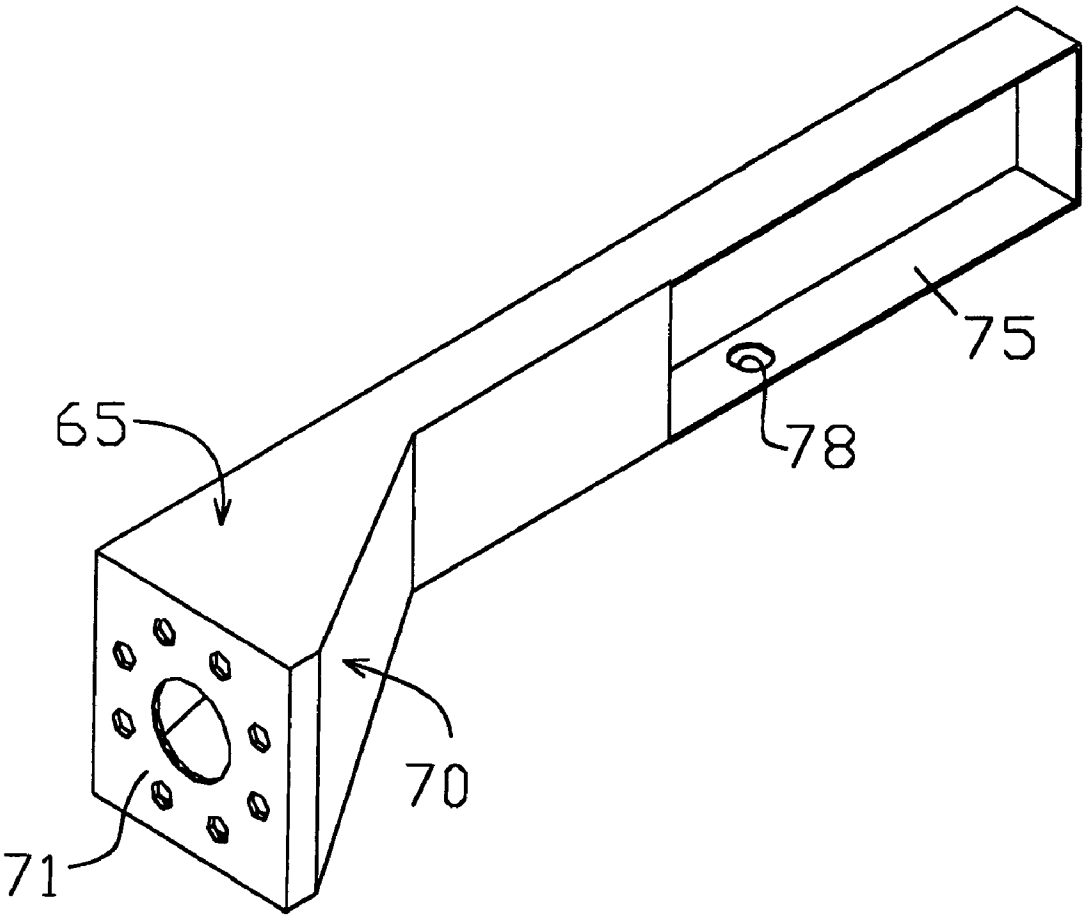
FIG. 4 is a perspective view of the intake plenum.

In the preferred embodiment, the pump system 23 is coupled in fluid communication with the tank through back wall 50. Referring to FIG. 2, pump system 23 includes a pump 67 and fluid conduits 64 to couple the pump between intake opening 26 and discharge openings 32. The fluid conduits in the preferred embodiment include: intake plenum 65, outlet piping 68, and side plenums 69. The dimensions of the intake plenum are approximately 46 inches in length, 7 inches in height, and 3 inches in width. The intake plenum is generally rectangular in cross section, except that it includes a flared portion, shown at 70, adjacent where the plenum connects to pump 67 (shown best in FIG. 4). At the end of plenum 65, the flared portion is approximately ten inches in width. The flared portion is approximately 13 inches in length. Referring to FIG. 4, the end of intake plenum 65 is flared to form end portion 71 that is adapted to mate with pump 67.

Figure 3:
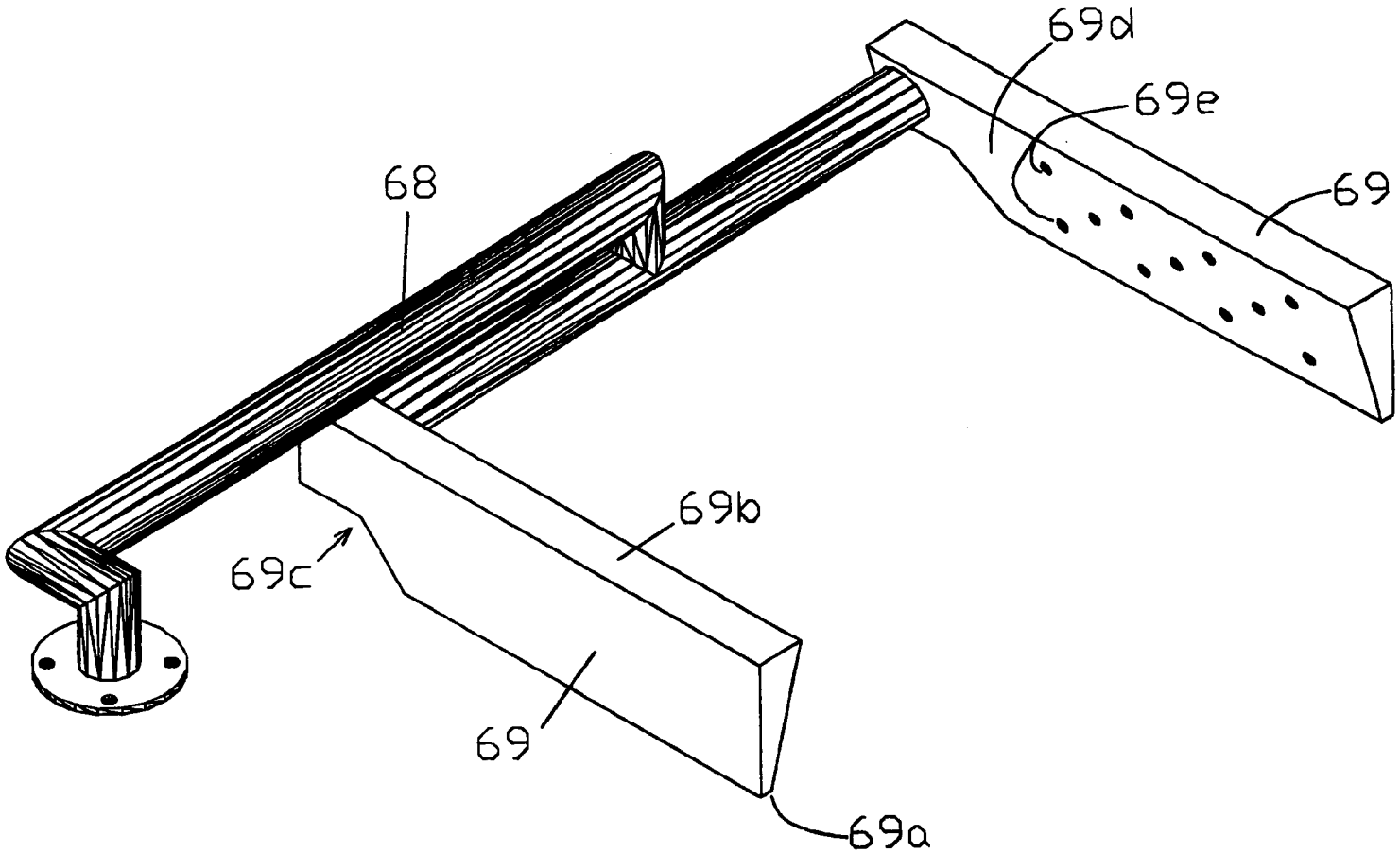
FIG. 3 is a perspective view of the outlet piping and side plenums.

The outlet piping 68 is preferably 3 inches in diameter. The side plenums 69 are configured as shown best in FIG. 3. The plenums 69 are about 32 inches in length and about 7½ inches in height. At bottom edge 69*a*, the plenums are about ¾ of inch wide and at the top edge 69*b*, the plenums are approximately 2¾ inches wide. The plenums include a notched portion 69*c* that is sized to accommodate the intake plenum 65. The plenums include an inner face 69*d* having openings 69*e* that correspond to the outlet or discharge openings 32. FIG. 3. The dimensions above are set forth as examples, and other dimensions and configurations will work without departing from the invention disclosed herein. Also, the invention will work adequately with discharge openings on only one wall, in which case only one side plenum is necessary. The pump system and discharge openings could be configured to be on the same wall. The configuration described is believed to be the best operationally.

The pump 67 draws cleaning fluid in the tank through intake opening 26 in back wall 50 through the intake plenum 65. The pump directs the cleaning fluid through the outlet piping 68 to side plenums 69 and out the discharge openings 32. The pump is a closed-coupled, end suction 4×3×5. It has a maximum capacity of 1800 rpms at 300 hundred gallons per minute. The pump includes an 1800 rpm, 4 pole 1–3 horsepower frequency drive duty motor.

As attached to intake opening 26, intake plenum 65 forms a sump 75 (see FIGS. 1 and 4). The intake opening 26 is preferably about 7 inches in height and 20 inches in length. The height and length of the intake opening are sized to correspond to a cutaway portion in intake plenum 65 (shown in FIG. 4 as sump 75). In this configuration, the pump 67 draws cleaning fluid through the intake opening into the intake plenum 65. Sump 75 can house a heater 77 (e.g., a heating element as shown) that attaches to the bottom wall at opening 78. The heater can also include a heat sensor 79 for sensing the temperature. The sensor is interfaced, as described below, to a microprocessor that causes the heater to maintain a specified temperature in the tank. A fluid sensor 81 can also be provided to determine whether a desired fluid level is in the tank. If the fluid sensor detects that the fluid level in the tank is not sufficient, it is interfaced to the microprocessor to deactivate the heater to ensure that the heating element and pump do not overheat. In the preferred embodiment, the fluid level sensor is a thermocouple that determines if the heater (e.g., the heating element) has risen above a designated temperature, a condition indicative that the fluid level dropped below the heater. Other fluid level sensors are well known in the art.

Figure 6:
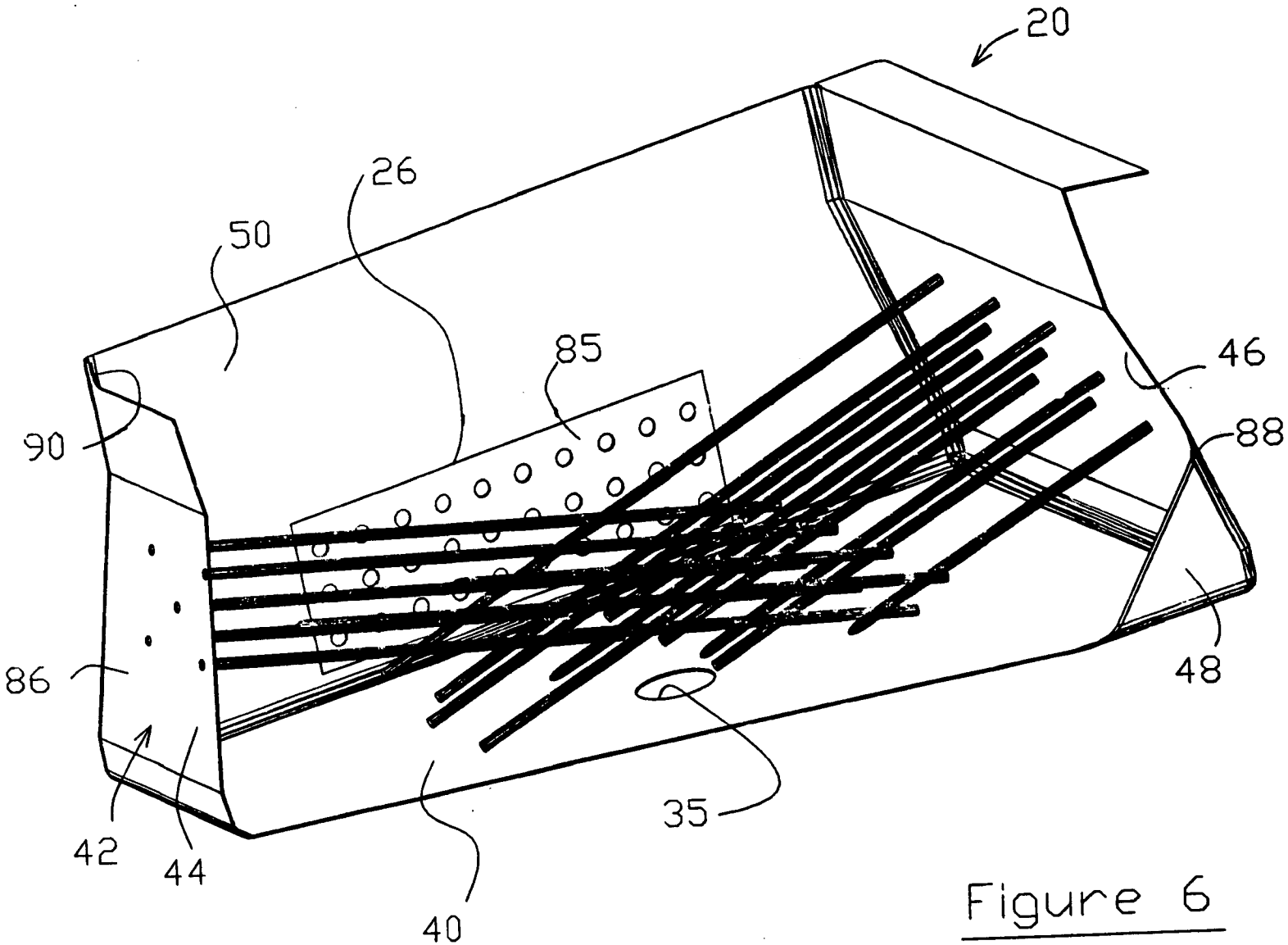
FIG. 6 is a perspective view with a portion broken away to reveal the crisscross fluid flow in the tank when fluid is circulated through the discharge openings.

Referring to FIGS. 6 and 9, a perforated cover 85 is preferably provided over intake opening 26. The cover 85 restricts food debris or dishware from entering intake opening 26 and entering the pump system 23. The cover 85 is preferably hingedly attached to the sump by hinge bars (not shown) or other known means. The cover swings open into the tank to provide access to the sump 75 and the heater contained therein.

The automated washer has outlets for directing fluid from the pump system 23 into the tank. As used herein, the term outlet broadly includes any opening, including prior known means such as pipes and nozzles for directing fluid into the tank. Pipes or nozzles could be used in combination with other inventive features of the present invention, such as the automated control system. In the preferred embodiment, the outlets are discharge openings 32. The term discharge openings, as used herein, refers to mere holes in the wall, or equivalent openings, that do not include separate parts such as pipes, nozzles, or the like for directing the fluid flow. Because it is desirable to have the fluid directed down into the tank 20 to avoid shooting fluid out of the tank, the walls 44 and 46, in the preferred embodiment, include a portion that is angled downwardly and at least some of the discharge openings are located on the angled portion, and, most preferably, all discharge openings are located on the angled portion. The same effect could be accomplished by angling the entire wall, but that configuration would reduce the size of the opening at the top of the tank. By providing openings on angled portions of walls, without angling the entire wall, the need to include separate pipes and nozzles to direct fluid down into the tank is eliminated and the size of the opening at the top of the tank is maximized. The present invention will, however, work fine by angling the entire wall and locating the discharge openings on the wall. If the entire wall is angled it, of course, includes angled portions, but, in the preferred embodiment, the angled portions are less than the entire wall, as shown, for example, in FIG. 8.

Figure 7:
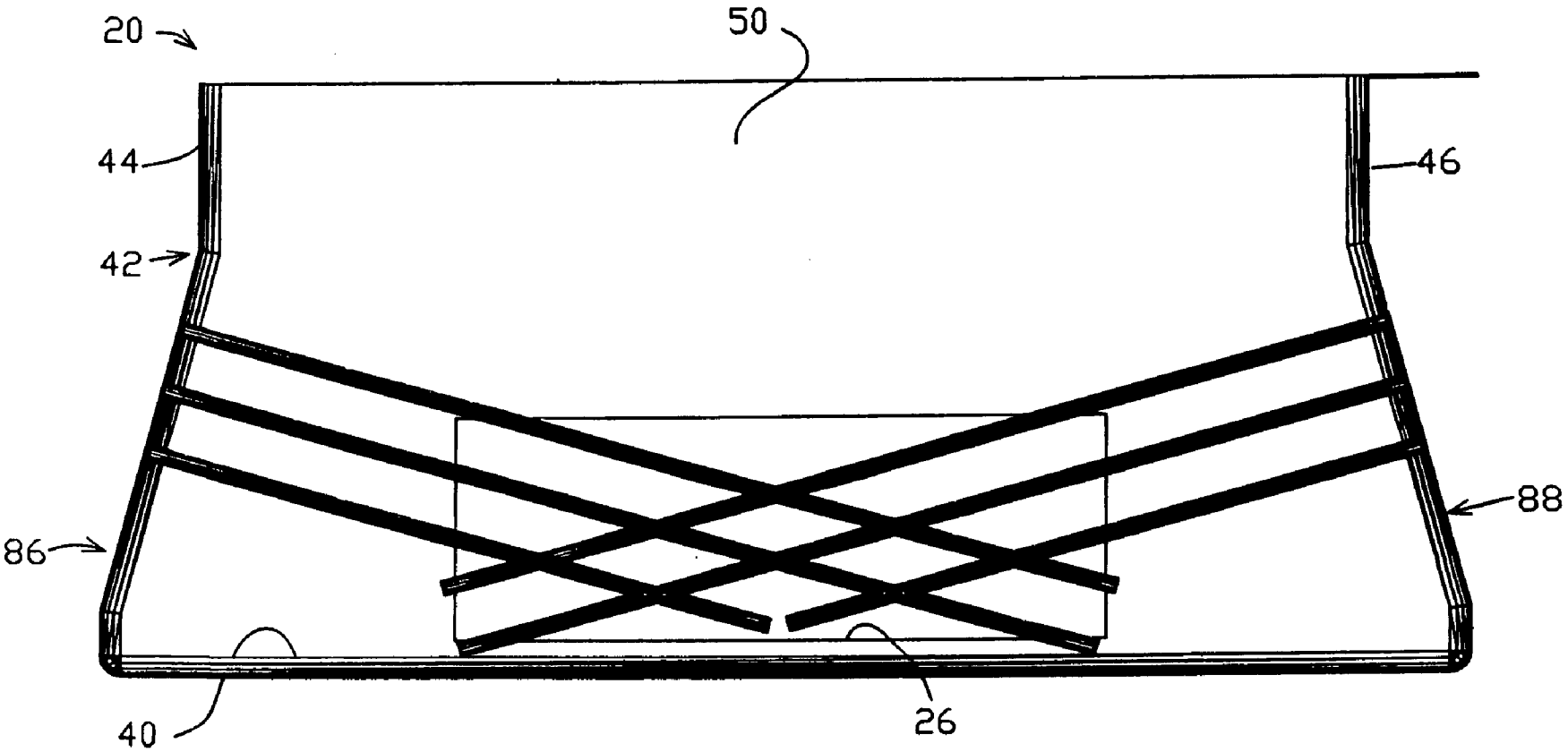
FIG. 7 is a cross-sectional view of the tank showing the crisscross pattern of fluid flow from the discharge openings.

In the preferred embodiment, the outlets or discharge openings 32 are provided on opposed walls, or in the case of a circular or oval tank, opposed portions of the curved wall. The automated washer will work with openings on only one wall, or on more than two walls, but placing the openings on two opposed walls is preferred. With the opposed configuration, turbulence in the tank is increased to facilitate cleaning kitchenware. In the most preferred embodiment, the opposed discharge openings are on the angled portions of walls 44 and 46 to form a crossing pattern, as shown in FIGS. 6 and 7. The crossing pattern causes a whirlpool effect in the tank to enhance the cleaning ability of the automated washer. The size of each opening is preferably 7/16 in diameter, but could be increased or decreased to achieve a desired velocity or flow rate through the opening.

Figure 8:
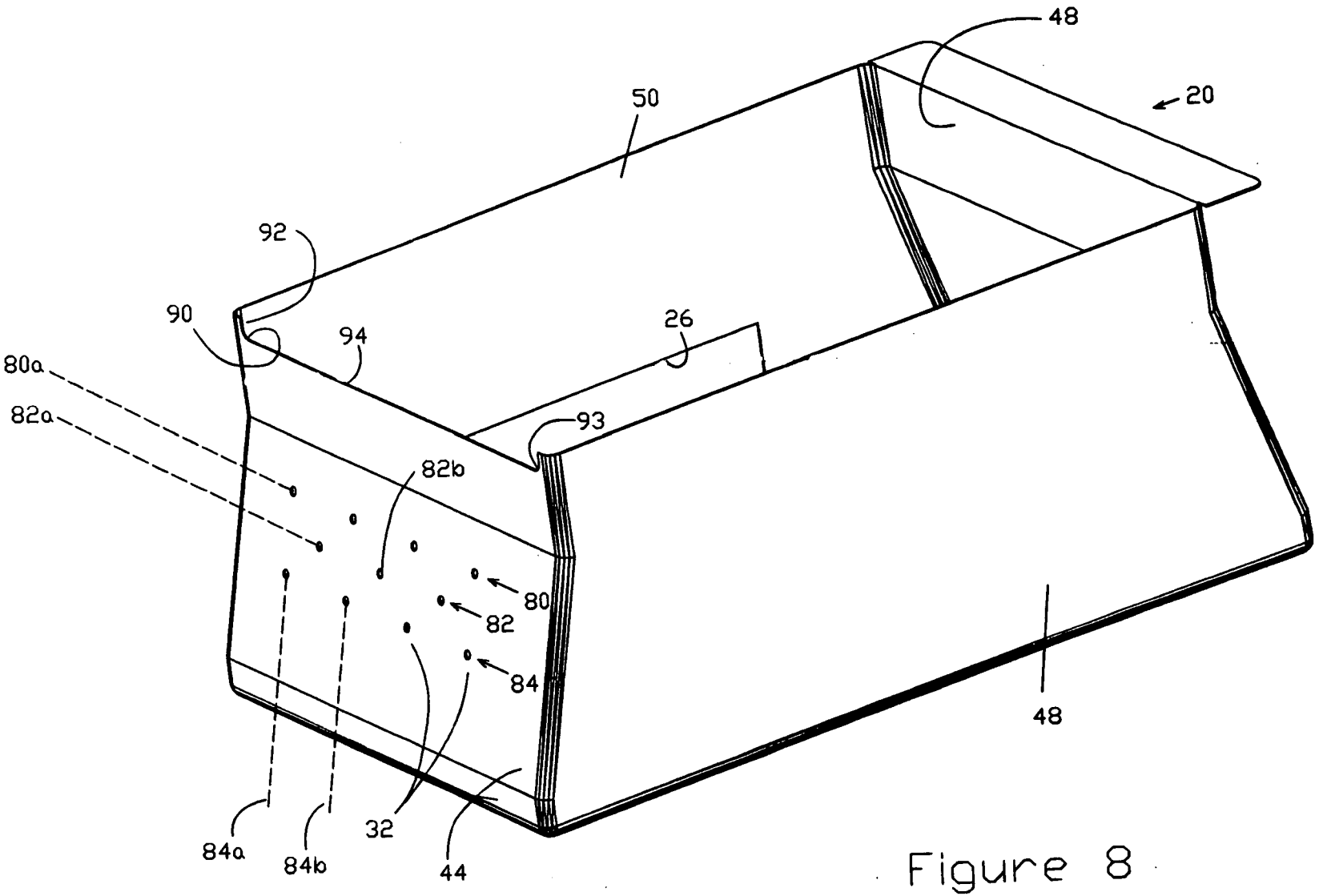
FIG. 8 is perspective view of the tank.

The openings on each wall are also preferably arranged in the pattern show in FIG. 8. The openings are arranged in three rows 80, 82, and 84. The distance between horizontal centers is about 5.27 inches (as shown in FIG. 8 between points 84*a* and 84*b*). The vertical distance between centers of the openings 32 in each row is about 1.94 inches (as shown in FIG. 8 between points 80*a* and 82*a*). The horizontal distance between hole centers for adjacent rows is half the distance between horizontal centers in a given row and is about 2.635 inches (as shown in FIG. 8 between points 82*b* and 84*b*). While the number and arrangement of openings 32 shown and described are preferred, the distances and number of discharge openings 32 can be altered.

Sidewalls 44 and 46 include angled portions upon which outlets or discharge openings are located. The angle portions 86 and 88, corresponding to walls 44 and 46, respectively, are shown best in FIGS. 6 and 7. The angled portions are preferably angled between about 60 degrees and 80 degrees and are most preferably about 75 degrees from the horizontal and 15 degrees from the vertical. Further, in the preferred embodiment, a pattern of discharge openings is located on each angled portion 86 and 88, again as shown in FIGS. 6 and 7 such that fluid directed through the discharge openings forms a crossing pattern as shown in those figures. To enhance the whirlpool effect in the tank, it is preferred to offset the opposing patterns on the opposed walls 44 and 46 so that the discharge openings are not on directly opposed paths. To accomplish this, the discharge openings pattern on wall 44 is shifted slightly to the left and the discharge openings pattern on wall 46 is shifted slightly to the right. On wall 44, the left most discharge openings are about 7.3 inches from the left edge of wall 44 and the right most discharge openings on wall 44 are about 4.6 inches from the right edge of wall 44. The adjustment is reversed on wall 46 to create the offset between opposed discharge openings. The arrangement shown creates the preferred whirlpool effect within the tank. The invention will, however, work well if the discharge openings on opposed walls are in direct opposed relationship. Turbulence in the tanks is still significant, but the whirlpool effect is less.

The automated washer also includes an overflow 90, shown best in FIG. 8. The overflow is formed as elongated cutaway portion formed between edges 92 and 93 in sidewall 44 adjacent its top edge. When fluid in the tank reaches the lip 94 of the overflow 90, water spills over into the scraping station 14 (FIG. 10) and down its drain. Further, grease and floating debris also spill over the lip 93 of the overflow 90 and are disposed of in the scraping station. The scraping station 14 is equipped to dispose of grease and debris. Thus, the overflow 90 serves two purposes: ensuring that the tank does not overfill and spill onto the surrounding floor and allowing grease or floating debris to be removed from the tank. The overflow could also be formed by cutting a narrow, elongated opening in sidewall 44, but the full cutaway portion described is preferred.

Figure 5:
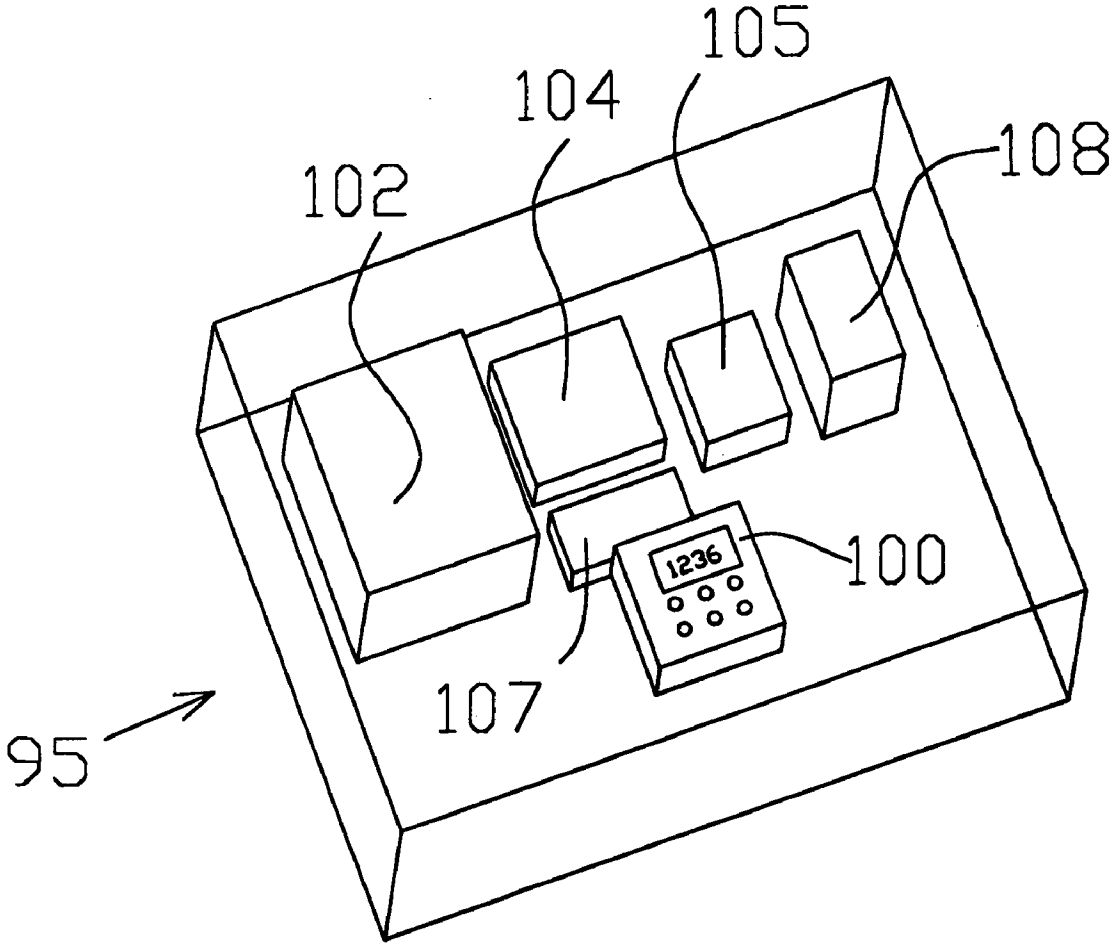
FIG. 5 is a perspective schematic view of the control system for the automated washing tank.

Referring to FIGS. 1 and 5, the automated washer also includes a control system 95 for activating the pump between various speeds, including an off-position. Referring to FIG. 5, the control system includes a controller 100 (e.g., a microprocessor) coupled to a frequency motor drive controller 102 by DC output relays 104. A control transformer 105 provides regulated power to controller 100. The parts described are set forth as mere examples. Other electronic or similar controls will work to control the automated features of the tank.

The controller 100 is preferably a multi-sequence microprocessor controller. It has real-time clock features, battery back-up for saving the wash cycle schemes (described below). It also includes 5 dc output features, including an alarm. It includes a programmable EPROM chip that allows custom software to be applied to control the various components of the washer, including the pump and heater. The specific unit is a "Mini-Chef" 2000 by Watlow Electric, although there are many options available to control the system, as well understood by those skilled in the art.

The microprocessor is programmable and is coupled to the frequency motor drive controller 102 to cause it drive the motor at a desired pump speed. The software in the microprocessor causes the frequency drive to lower or increase the hertz cycle of the motor to therefore cause the motor to speed up or slow down. That, in turn, causes the pump pressure to increase or decrease. In the preferred embodiment, the microprocessor is programmed to provide 5 speeds or flow rates from which to choose, varying from a delicate cycle to handle the most fragile dishware and for soaking to the most robust cycle that is adapted to break away caked-on food debris on commercial pots and pans. In another aspect of the invention, the microprocessor is programmed to provide at least one preset wash cycle program and preferably several programs.

The microprocessor 100 is also coupled to heater 77 to control the heat. The control system includes controls that control the microprocessor to cause the heater to heat the fluid in the tank to a specified temperature. The microprocessor 100 is coupled to the heater 77 through a solid-state relay 108. The microprocessor can be programmed to provide a wash cycle program that provides cycles for predetermined time periods and the pump speed (i.e. tank turbulence) and/or heat can be varied to provide predetermined cleaning cycles. Thus, the tank may operate at a mild presoak turbulence level at a higher (uncomfortable to the touch) heat to loosen caked-on food from the dishware, followed by a more turbulent pressure in the tank to break away loosened food debris, followed by a final cycle at reduced temperature during which employees can finish the cleaning process. As one example program, the following sequence is provided: upon activation of the control to activate the program, the following logic steps are performed by the controller and associated sensors: determine whether the fluid temperature is at 110 degrees; if it is not, cause the heater to heat the fluid to 110 degrees; when the fluid temperature is at 110 degrees, initiating a 3 minute presoak cycle during which time the motor operates at between about 30–35 hertz; next proceeding to a 3 minute intermediate cycle during which time cycle the pump is increased to 40–45 hertz, thus increasing tank turbulence and cleaner agitation; followed by a heavy duty clean cycle during which time cycle the pump is increased to 50–60 hertz for 8 minutes; followed finally by an idle mode at about 30 hertz which prevents grease suspended in the cleaning fluid from settling back onto the kitchenware and allows removal of the kitchenware from the tank. It is contemplated that overnight cycles can also be provided that allow the tank temperature to be increased to much higher temperatures of around 150 degrees or higher to further facilitate cleaning. Because such temperatures are too hot for the human touch, the most difficult-to-clean kitchenware could be cleaned overnight for extended periods of time while personnel are not around and thus are not exposed to the hot tank of water. It is also contemplated that a cover could be provided to prevent personnel from putting their hands in the water and/or alarms can be activated to warn of the hot water temperature. The microprocessor of the preferred invention provides preprogrammed wash cycle programs, but is also adapted to allow the user to create programs to cater to specific cleaning needs.

A terminal block 107 is also provided for incoming power and/or junction points for wiring connections. A solid state heater relay 108 is also provided to interface the heater 77 to the controller 100.

In another aspect of the present invention, an automatic cleaner dispenser system is provided to automatically dispense cleaner into fluid in the tank to clean the kitchenware in the tank. The controller 100 is coupled to a cleaner dispenser 110, e.g., a peristaltic dosing injection pump, through the dc relays 104 to automatically dispense a specified amount of cleaner in the tank based upon a predetermined, monitored condition. While the microprocessor/controller can be programmed to cause the dispenser 110 to provide cleaner at specified time intervals or based on other parameters, the preferred method is based upon fluid changes within the tank. The microprocessor is coupled to the fluid level sensor 81. When the fluid level drops below the heating element, the fluid level sensor detects that condition, a condition typically only resulting from a water change in the tank, but, regardless, a condition that requires fluid (typically tap water) to be added to the tank. When fluid is added to the tank, there is no cleaning agent in the fluid, and cleaning agent should therefore be added. In the past, employees would manually add cleaning agent to the water upon refilling the tank. Adding too much soap creates a "soap suspension" problem, which diminishes the ability of the soap to attack grease and also leads to added cost due to overuse of the cleaner. Adding too little cleaner or soap is not sanitary and not efficient in removing grease, films, and other food debris from the kitchenware.

In the present invention, when the fluid level sensor 81 detects that the fluid level is too low, i.e., below the heating element, the control system shuts down the automated washer. When fluid is added to the tank, typically during a refill operation, the fluid level sensor detects that the fluid level is sufficient again. Prior to reinitiating the pump and heater, the microprocessor causes the soap dispenser (e.g., the peristaltic pump) to dispense a predetermined amount of cleaner into the intake plenum, and, thus, into the tank's water or fluid. The cleaner dispenser 110 is preferably located behind the control panel and includes a feed line 112 that supplies cleaner into intake plenum 65, thus the cleaner injection process is performed out of the way of the tank and kitchenware in the tank. In the case of a peristaltic pump, the dispenser includes a line that couples the pump to a supply of cleaner (not shown). The dispenser and cleaner supply are positioned to be out of the way to prevent damage to the dispenser 110 during operation of the washer. The cleaner dispenser system could, however, be located anywhere on the tank that allows the dispenser to dispense cleaner into the tank, as is understood by those skilled in the art.

The control system preferably includes a control panel 96 (shown in FIG. 1) that includes controls 97 for activating the pump speeds, wash cycles, heater, and cleaner dispenser and a digital readout screen 99 for displaying programmed information and other information pertinent to the use and operation of the microprocessor and control system. A laminated covered or transparent membrane (not shown) is preferably provided to protect the control panel 96 from fluid spills from the tank 20.

While a preferred automated washer has been described in detail, various modifications, alterations, and changes may be made without departing from the spirit and scope of the washer according to the present invention as defined in the appended claims.

What is claimed is:

1. An automated kitchenware washing tank comprising a tank with a wall that defines an enclosure for holding a fluid for washing kitchenware, outlets in the wall for directing fluid into the tank, an intake opening in the tank, a pump system comprising a pump and a fluid conduit system coupling the pump between the intake opening and the outlets, whereby the pump is adapted to pump fluid from within the tank through the intake opening into the pump system and through the outlets into the tank at a flow rate, and a control system comprising a controller coupled to the pump system for causing the pump to pump fluid at least two different flow rates through the outlets, and controls to select between the at least two different flow rates, wherein the enclosure wall of the tank has at least two angled portions facing generally downwardly, wherein the outlets are discharge openings and at least some of the discharge openings are formed in each of the angled portions of the wall to direct the fluid generally downwardly into the tank.

2. The automated kitchenware washing tank of claim 1 wherein the at least two angled portions comprise two angled portions formed on opposed portions of the enclosure wall.

3. The automated kitchenware washing tank of claim 2 wherein all of the discharge openings are formed in the angled portions of the enclosure wall.

4. The automated kitchenware washing tank of claim 3 further comprising a drain having a drain opening in one of the walls with a drain pipe connected to the drain opening to allow the tank to be emptied and a valve coupled to the drain and being operable to open and close the drain, thus allowing the tank to be emptied and filled.

5. The automated kitchenware washing tank of claim 2 wherein each angled portion of the wall has at least two rows of discharge openings and at least two discharge openings per row.

6. The automated kitchenware washing tank of claim 5 wherein the angled portions are at about 75 degrees from horizontal, wherein the discharge openings direct fluid into the tank in a crossing pattern.

7. The automated kitchenware washing tank of claim 6 wherein each angled portion of the enclosure wall has at least three rows of discharge openings and at least three discharge openings per row.

8. The automated kitchenware washing tank of claim 2 further comprising an overflow formed on the enclosure wall by an elongated cutaway portion in the upper portion of the enclosure wall.

9. The automated kitchenware washing tank of claim 2 further comprising a heater to heat the fluid in the tank, a heat sensor to detect the temperature of the fluid in the tank, and a fluid level sensor to detect whether the fluid is above or below a desired level in the tank.

10. The automated kitchenware washing tank of claim 9 wherein one of the fluid conduits of the fluid conduit system comprises a plenum that is coupled to the intake opening to form a sump and the heater is disposed in the sump, and wherein the tank further comprises a perforated closure that is hingedly attached to the tank to restrict food debris and dishware from entering the intake opening.

11. The automated kitchenware washing tank of claim 1 wherein the control system further comprises a controller programmed with at least one preset program and wherein the control system allows the preset program to be selected and operated, the program controlling the controller to operate the pump through at least two timed cycles, with different flow rates.

12. The automated kitchenware washing tank of claim 11 further comprising a heater for heating the fluid within the tank and wherein the controller is interfaced to the heater to cause the heater to vary the temperature of the fluid within the tank between the cycles.

13. The automated kitchenware washing tank of claim 1 further comprising a cleaner dispenser for dispensing cleaner into the fluid in the tank to facilitate cleaning the kitchenware and wherein the control system is interfaced to the cleaner dispenser for automatically causing the cleaner dispenser to dispense cleaner into the fluid.

14. The automated kitchenware washing tank of claim 1 wherein one of the fluid conduits of the fluid conduit system comprises a plenum that is coupled to the intake opening to form a sump, and wherein the tank further comprises a perforated closure that is hingedly attached to the tank to restrict food debris and dishware from entering the intake opening.

15. The automated kitchenware washing tank of claim 1 further comprising a heater for heating the fluid within the tank, and wherein the controller is programmed with at least one preset program for controlling the heater to heat the fluid within the tank to a temperature equal to or greater than about 110° F.

16. The automated kitchenware washing tank of claim 1 further comprising an alarm configured to provide a notification when the fluid temperature within the tank is greater than a predetermined safe fluid temperature.

17. The automated kitchenware washing tank of claim 1 wherein the at least two different flow rates includes at least a first flow rate and a second flow rate, wherein said first flow rate is greater than said second flow rate and wherein said pump system pumps fluid at said first flow rate for washing said kitchenware and said pump system pumps fluid at said second flow rate for preventing grease from settling onto said kitchenware during an idle mode of operation.

18. The automated kitchenware washing tank of claim 17 wherein said pump system includes a motor controlled by said controller, said motor operating at about 30 hertz when said pump system pumps fluid at said second flow rate.

19. The automated kitchenware washing tank of claim 1 further comprising a heater to heat the fluid in the tank, and a sensor to detect the temperature of the fluid in the tank, and wherein the controller is programmed with at least one preset program for controlling the heater to heat the fluid in the tank to a temperature equal to or greater than about 110° F.

20. The automated kitchenware washing tank of claim 1 further comprising a heater to heat the fluid in the tank, and a cover for the tank enclosure, wherein the controller is programmed with at least one preset program for controlling the heater to heat the fluid in the tank to a temperature equal to or greater than about 150° F., and wherein said cover is configured to substantially enclose the tank enclosure when the controller is operating under the control of the preset program for heating the fluid to a temperature of equal to or greater than 150° F.

21. The automated kitchenware washing tank of claim 1 further comprising a heater to heat the fluid in the tank, and wherein the controller is programmed with at least one preset program for controlling the heater during an overnight period.

22. An automated kitchenware washing tank comprising a tank with a wall that defines an enclosure for holding a fluid for washing kitchenware, outlets in the wall for directing fluid into the tank, an intake opening in the tank, a pump system comprising a pump and a fluid conduit system coupling the pump between the intake opening and the outlets, whereby the pump is adapted to pump fluid from within the tank through the intake opening into the pump system and through the outlets into the tank at a flow rate, a control system comprising a controller coupled to the pump system for causing the pump to pump fluid at least at a first flow rate and at a second flow rate, wherein said first flow rate is greater than said second flow rate and wherein said pump system pumps fluid at said first flow rate for washing said kitchenware and said pump system pumps fluid at said second flow rate for preventing grease from settling onto said kitchenware, wherein the control system includes an idle mode, said controller operating said pump system at said second flow rate during said idle mode.

23. The automated kitchenware washing tank of 22 further comprising a heater to heat the fluid in the tank, a heat sensor to detect the temperature of the fluid in the tank, and a fluid level sensor to detect whether the fluid is above or below a desired level in the tank.

24. An automated kitchenware washing tank comprising:

a tank with a wall that defines an enclosure for holding a fluid for washing kitchenware;

outlets in the wall for directing fluid into the tank;

an intake opening in the tank;

a pump system comprising a pump and a fluid conduit system coupling the pump between the intake opening and the outlets;

a heater to heat the fluid in the tank;

a temperature sensor to detect the temperature of the fluid in the tank;

a control system including a controller coupled to the pump system for causing the pump to pump fluid at least two different flow rates through the outlets, said controller programmed with at least two preset programs, wherein at least one of the preset programs controls the heater to heat the fluid in the tank to a temperature equal to or greater than about 150° F. and at least one preset program is a program configured to control the heater during an overnight period.

25. An automated kitchenware washing tank comprising a tank with a wall that defines an enclosure for holding a fluid for washing kitchenware, outlets in the wall for directing fluid into the tank, an intake opening in the tank, a pump system comprising a pump and a fluid conduit system coupling the pump between the intake opening and the outlets, whereby the pump is adapted to pump fluid from within the tank through the intake opening into the pump system and through the outlets into the tank at a flow rate, and a control system comprising a controller coupled to the pump system for causing the pump to pump fluid at least two different flow rates through the outlets, and controls to select between the at least two different flow rates, wherein the controller is programmed with at least two preset programs and wherein the control system allows at least one preset program to be selected and operated, the program controlling the controller to operate the pump through at least two timed cycles, with different flow rates, and a heater to heat the fluid in the tank, wherein the controller is programmed with at least one preset program for controlling the heater during an overnight period.

* * * * *

UNITED STATES PATENT AND TRADEMARK OFFICE

CERTIFICATE OF CORRECTION

PATENT NO. : 7,021,321 B2
APPLICATION NO. : 10/674913
DATED : April 4, 2006
INVENTOR(S) : James W. Bigott It is certified that error appears in the above-identified patent and that said Letters Patent is hereby corrected as shown below:

Column 10,
Line 26, insert -- at -- before "at least two".

Column 12,
Line 52, replace the period after "150ºF" with a comma.
Line 65, insert -- at -- before "at least two".

Signed and Sealed this

Twenty-seventh Day of June, 2006

JON W. DUDAS
*Director of the United States Patent and Trademark Office*